US012186793B2

(12) United States Patent
Takada

(10) Patent No.: US 12,186,793 B2
(45) Date of Patent: Jan. 7, 2025

(54) SPINNING DEVICE AND SPINNING METHOD

(71) Applicant: NIHON SPINDLE MANUFACTURING CO., LTD., Hyogo (JP)

(72) Inventor: Yoshiaki Takada, Hyogo (JP)

(73) Assignee: Nihon Spindle Manufacturing Co., Ltd., Hyogo (JP)

( * ) Notice: Subject to any disclaimer, the term of this patent is extended or adjusted under 35 U.S.C. 154(b) by 240 days.

(21) Appl. No.: 17/890,045

(22) Filed: Aug. 17, 2022

(65) Prior Publication Data

US 2022/0388050 A1 Dec. 8, 2022

Related U.S. Application Data

(63) Continuation of application No. PCT/JP2021/005434, filed on Feb. 15, 2021.

(30) Foreign Application Priority Data

Jul. 6, 2020 (JP) ..... 2020-116155

(51) Int. Cl.

| | |
|---|---|
| ***B21D 19/04*** | (2006.01) |
| ***B21D 22/16*** | (2006.01) |
| ***B21D 41/04*** | (2006.01) |
| ***B21H 1/20*** | (2006.01) |
| ***B21K 21/12*** | (2006.01) |

(52) U.S. Cl.

CPC ..... *B21D 22/16* (2013.01); *B21D 19/046* (2013.01); *B21D 41/04* (2013.01); *B21H 1/20* (2013.01); *B21K 21/12* (2013.01)

(58) Field of Classification Search

CPC ..... B21D 19/046; B21D 19/06; B21K 21/12

See application file for complete search history.

(56) References Cited

U.S. PATENT DOCUMENTS

| | | | | |
|---|---|---|---|---|
| 2,610,304 | A | 9/1952 | Garner et al. | |
| 11,583,911 | B2 | 2/2023 | Sun et al. | |
| 2002/0100305 | A1* | 8/2002 | Sczesny | B21K 21/12 72/115 |

(Continued)

FOREIGN PATENT DOCUMENTS

| | | | |
|---|---|---|---|
| CN | 110548797 | A | 12/2019 |
| JP | H0270327 | A * | 9/1988 |
| JP | H02-070327 | A | 3/1990 |

(Continued)

OTHER PUBLICATIONS

Translation of JP-2014094384 (Year: 2014).*

(Continued)

*Primary Examiner* — Bobby Yeonjin Kim

(74) *Attorney, Agent, or Firm* — Michael Best & Friedrich LLP

(57) ABSTRACT

A spinning device includes a flange forming section that, in a state where a base material having a tubular shape and including at least a large-diameter portion and a small-diameter portion is relatively rotated, forms a flange portion protruding in a direction away from a center axis by pressing the large-diameter portion in a center axis direction of the base material while contacting an outer peripheral portion of the small-diameter portion.

11 Claims, 9 Drawing Sheets

(56) References Cited

U.S. PATENT DOCUMENTS

| | | | |
|---|---|---|---|
| 2017/0175836 | A1 | 6/2017 | Iwai et al. |
| 2022/0088664 | A1 | 3/2022 | Sun et al. |

FOREIGN PATENT DOCUMENTS

| | | | | |
|---|---|---|---|---|
| JP | 2006-159250 | A | | 6/2006 |
| JP | 2011-115813 | A | | 6/2011 |
| JP | 2014094384 | A | * | 5/2014 |
| WO | WO-2020137077 | A1 | * | 7/2020 |

OTHER PUBLICATIONS

Translation of JP-H0270327 (Year: 1988).*
Translation of WO-2020137077 (Year: 2020).*
Search report isued in European Application No. 21836986.6, dated Nov. 22, 2023.
International Search Report issued in Application No. PCT/JP2021/005434, mailed Apr. 13, 2021.

* cited by examiner

SPINNING DEVICE AND SPINNING METHOD

RELATED APPLICATIONS

The contents of Japanese Patent Application No. 2020-116155, and of International Patent Application No. PCT/JP2021/005434, on the basis of each of which priority benefits are claimed in an accompanying application data sheet, are in their entirety incorporated herein by reference.

BACKGROUND

Technical Field

Certain embodiments of the present invention relate to a spinning device and a spinning method.

Description of Related Art

Automobile parts include, for example, shafts. The shafts may be obtained by machining a cylindrical base material.

The related art discloses a spinning device that performs thin-wall working on a cylindrical base material (workpiece). This spinning device includes a rotating roller that makes an outer peripheral wall portion of the base material thin by ironing.

SUMMARY

According to an aspect of the present invention, there is provided a spinning device including a flange forming section that, in a state where a base material having a tubular shape and including at least a large-diameter portion and a small-diameter portion is relatively rotated, forms a flange portion protruding in a direction away from a center axis by pressing the large-diameter portion in a center axis direction of the base material while contacting an outer peripheral portion of the small-diameter portion.

According to another aspect of the present invention, there is provided a spinning method including a machining process of performing machining on a base material having a tubular shape and including at least a large-diameter portion and a small-diameter portion. In the machining process, a flange forming section is used to form a flange portion protruding in a direction away from a center axis by pressing the large-diameter portion in a center axis direction of the base material while contacting an outer peripheral portion of the small-diameter portion in a state where the base material is relatively rotated.

DETAILED DESCRIPTION

Figure 1:
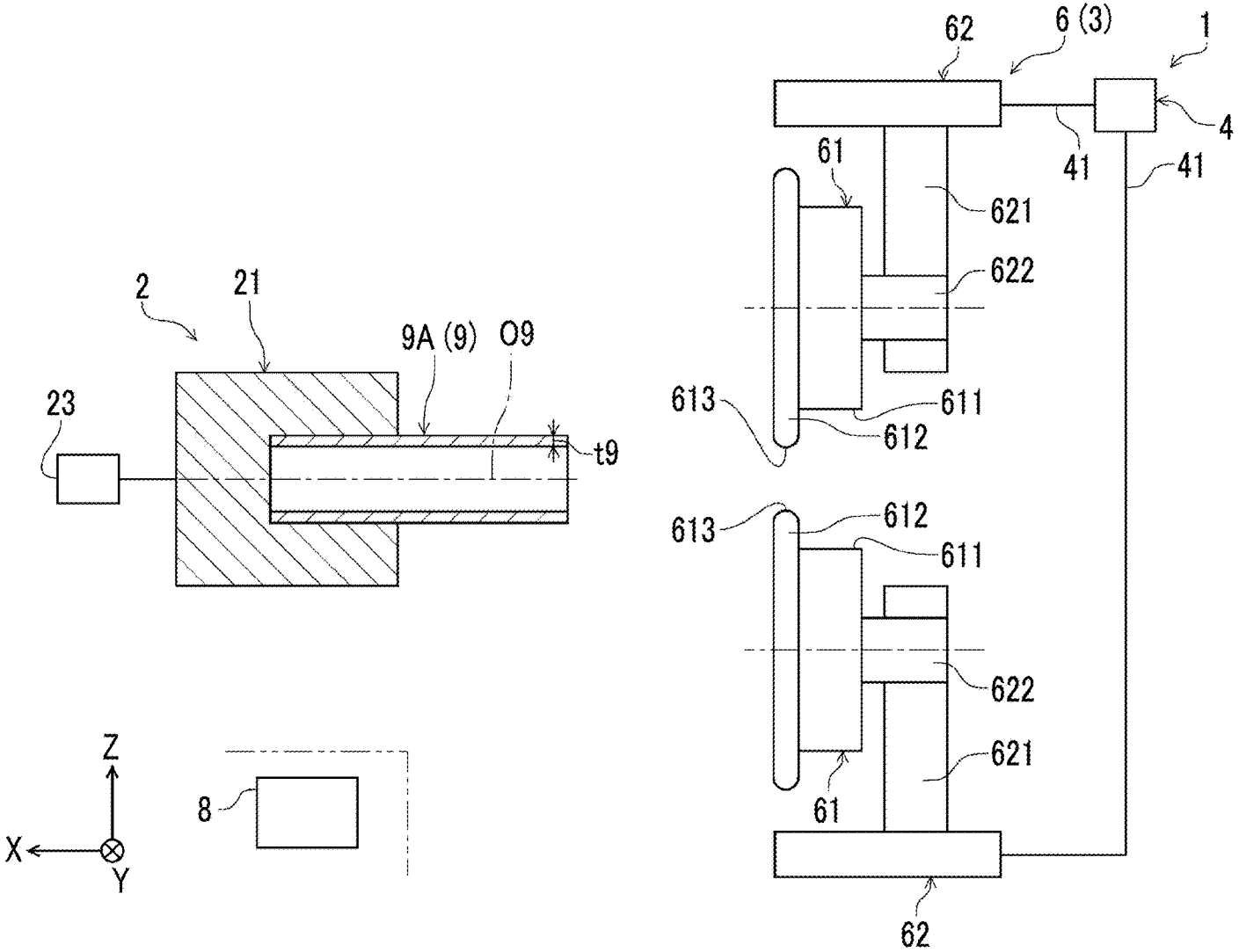
FIG. 1 is a partial vertical cross-sectional side view (before a small-diameter portion forming process) sequentially showing the operating state (before small-diameter portion forming) of a spinning device (one embodiment) of the present invention.

However, when a member subjected to the thin-wall working is to be used for a shaft, the strength (deformation resistance) of the member may decrease by a thin-walled amount, and may be difficult to withstand the actual usage environment.

Additionally, there is one having a flange portion for the shaft. It is known that even in a case where a cylindrical base material is machined to form the flange portion, an adjacent portion of the flange portion is thin-walled, which causes a decrease in strength.

It is desirable to provide a spinning device and a spinning method capable of easily forming a flange portion while maintaining the wall thickness of a base material when the flange portion is formed in a base material having a tubular shape.

According to the present invention, when the flange portion is formed, the large-diameter portion is pressed and deformed in the center axis direction of the base material. Accordingly, the large-diameter portion is partially crushed and reduced in diameter to become a diameter-reduced portion. Additionally, when a part of the large-diameter portion becomes the diameter-reduced portion, a surplus of volume is generated in the large-diameter portion by that amount. This surplus is raised and deformed in the direction away from the center axis of the base material to become the flange portion.

Additionally, as previously mentioned, the large-diameter portion of the base material is pressed along the center axis of the base material. Such pressing allows the wall thickness of the base material to be increased or almost the same. Accordingly, the wall thickness in the formed product obtained from the base material is not reduced as much as possible, and is maintained in a state close to constant with the size of the wall thickness in the base material.

Hereinafter, a spinning device and a spinning method of the present invention will be described in detail on the basis of preferred embodiments shown in the accompanying drawings.

One Embodiment

Hereinafter, one embodiment of the spinning device and the spinning method of the present invention will be described with reference to FIGS. 1 to 8. In addition, in the following, for convenience of explanation, three axes perpendicular to each other are set to an X-axis, a Y-axis, and a Z-axis. As an example, an XY plane including the X-axis and the Y-axis is horizontal, and the Z-axis is vertical. Additionally, in FIGS. 1 to 6 (the same applies to FIGS. 9 and 10), an upper side may be referred to as "up (or upper)" and a lower side may be referred to as "down (or lower)".

As shown in FIGS. 1 to 4, the spinning device 1 includes a rotation support unit 2, a machining unit 3, a first moving mechanism unit 4, and a second moving mechanism unit 5. The spinning device 1 can form a base material 9 to obtain a formed product 9C from the base material 9. Then, the formed product 9C is used, for example, as a shaft.

Figure 7:
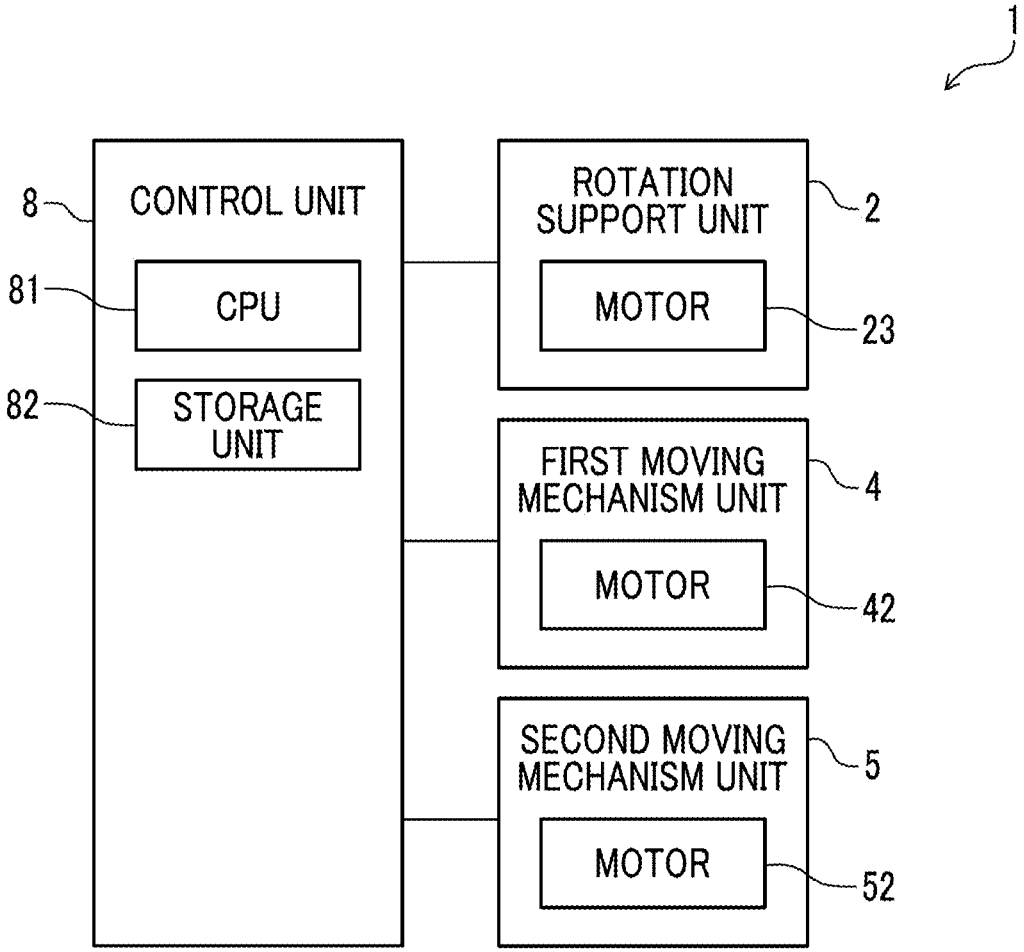
FIG. 7 is a block diagram showing main parts of the spinning device (one embodiment) of the present invention.

Additionally, as shown in FIG. 7, the spinning device 1 includes a control unit 8 electrically connected to the rotation support unit 2, the first moving mechanism unit 4, and the second moving mechanism unit 5.

Figure 8:
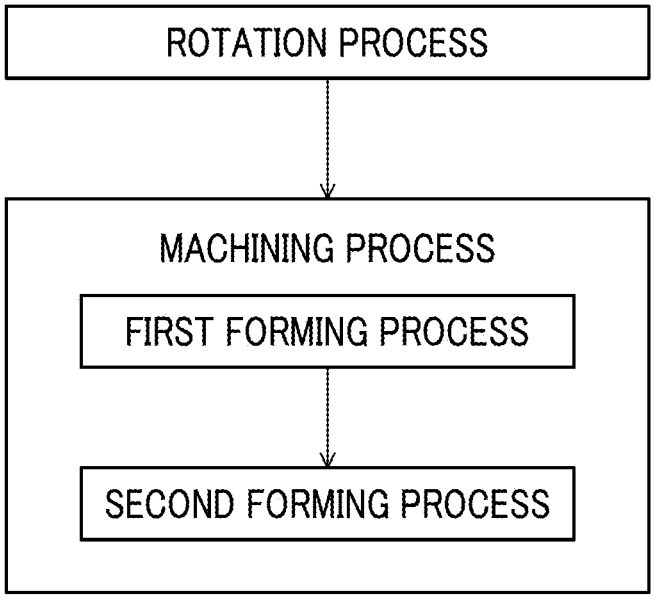
FIG. 8 is a diagram sequentially showing processes of a spinning method of the present invention.

As shown in FIG. 8, the spinning device 1 can execute the spinning method of the present invention, that is, a rotation process and a machining process in order. Additionally, in the machining process, a first forming process (small-diameter portion forming process) and a second forming process (flange portion forming process) are executed in order.

The base material 9 is a member having a cylindrical shape (circular tubular shape) in the present embodiment. In addition, the base material 9 is not limited to the member having a cylindrical shape as long as the base material has a tubular shape. Additionally, the base material 9 is made of a metal material such as carbon steel for machine structure, aluminum, stainless steel and the like.

Figure 2:
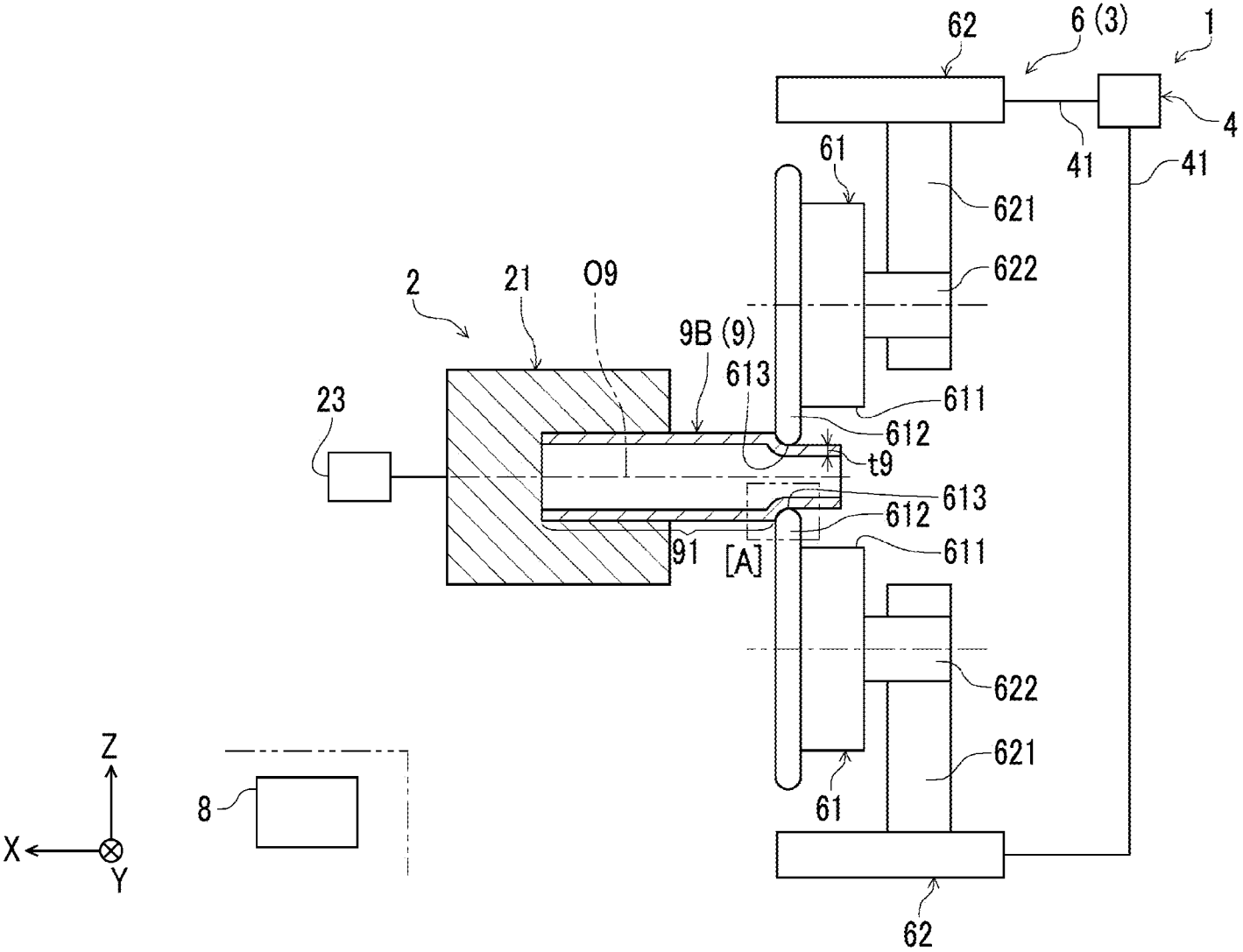
FIG. 2 is a partial vertical cross-sectional side view sequentially showing the operating state (during the small-diameter portion forming) of the spinning device (one embodiment) of the present invention.
Figure 3:
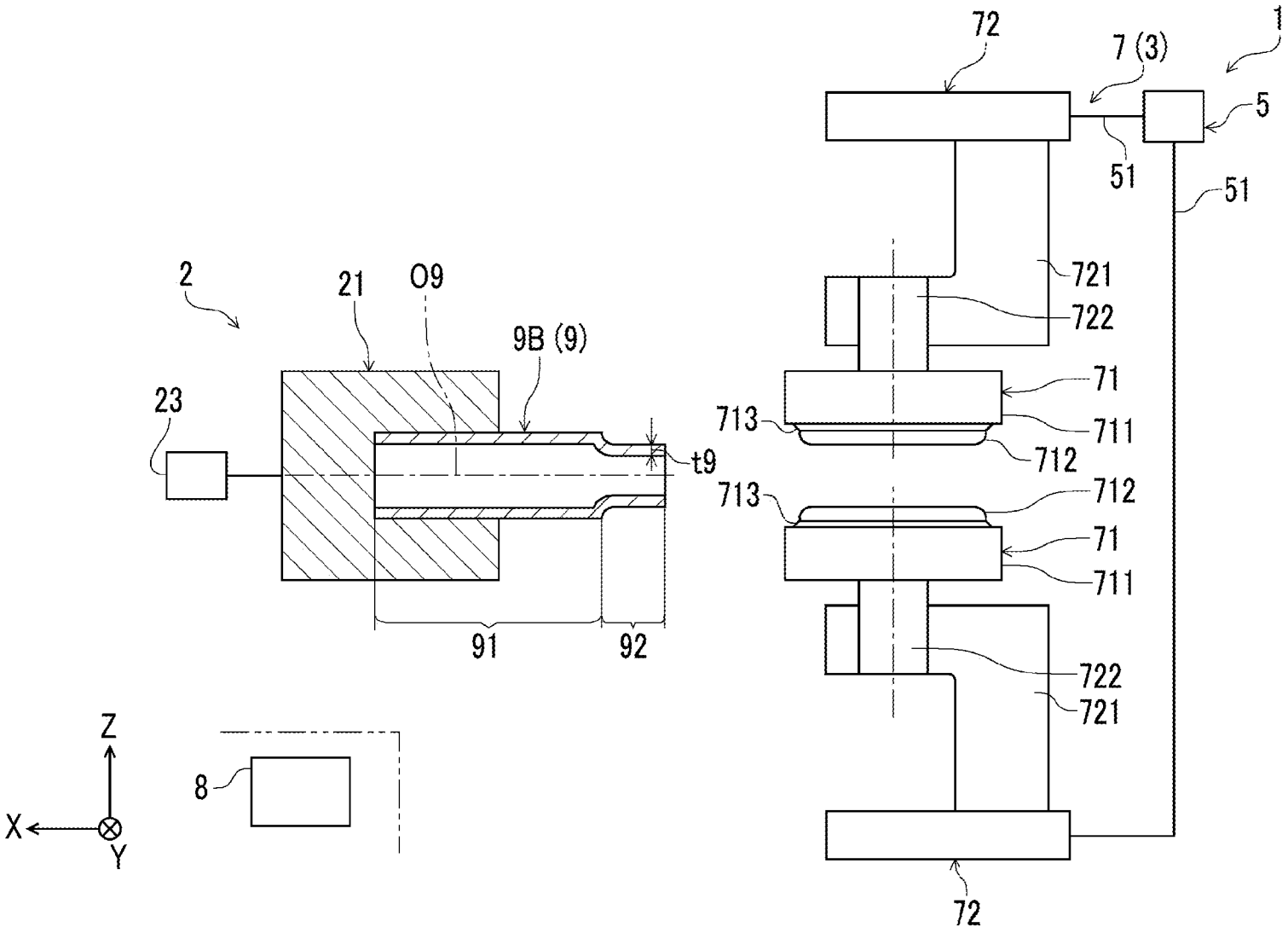
FIG. 3 is a partial vertical cross-sectional side view sequentially showing the operating state (before flange portion forming) of the spinning device (one embodiment) of the present invention.

The base material 9 has a state of a primary base material 9A shown in FIG. 1 and a state of a secondary base material 9B shown in FIGS. 2 and 3. Then, the base material 9 become the formed product 9C shown in FIG. 4 via the state of the secondary base material 9B from the state of the primary base material 9A. The formed product 9C is used as a shaft.

The size of the outer diameter and the inner diameter of the primary base material 9A is constant in the direction of a center axis O9. Therefore, the wall thickness (thickness of the wall portion) t9 of the base material 9, that is, the size (value) obtained by subtracting the inner diameter from the outer diameter is also constant in the direction of the center axis O9. As will be described below, the wall thickness t9 is maintained constant as it is until the formed product 9C is obtained. In addition, the "constant" will be described below and defined.

The secondary base material 9B has a large-diameter portion 91 and a small-diameter portion 92 disposed adjacent to each other in the direction of the center axis O9. The large-diameter portion 91 and the small-diameter portion 92 have different outer diameter and inner diameter sizes. In addition, a radius difference between the outer diameters of the large-diameter portion 91 and the small-diameter portion 92 is not particularly limited, but is preferably, for example, the wall thickness t9 or more, and more preferably 1 time or more and 2 times or less the wall thickness t9 (the same applies to a difference in inner diameter). Accordingly, for example, the forming of the flange portion 93 in the second forming process becomes easy. Additionally, this contributes to making the wall thickness t9 constant until the secondary base material 9B becomes the formed product 9C.

The rotation support unit 2 can rotatably support the machining unit 3 and the base material 9 relative to each other around the center axis O9. Accordingly, the rotation process is performed. In the present embodiment, the rotation support unit 2 is configured to rotate the base material 9 around the center axis O9 with respect to the machining unit 3.

As shown in FIGS. 1 to 4, the rotation support unit 2 has a chuck 21 and a motor 23.

The chuck 21 holds one end side of the base material 9, that is, a positive side in an X-axis direction. Accordingly, the base material 9 is cantilevered in a posture in which the center axis O9 is parallel to the X-axis.

The motor 23 is connected to the chuck 21. As the motor 23 operates, the power thereof is transmitted to the chuck 21. Accordingly, the base material 9 can be rotated around the center axis O9. In addition, in the spinning device 1, the rotation speed of the motor 23 can be changed by adjusting the voltage applied to the motor 23.

The machining unit 3 can perform plastic working on the base material 9. Accordingly, the machining process is performed. The machining unit 3 includes a first forming section 6 and a second forming section 7.

The first forming section 6 is a small-diameter portion forming section that is used in the first forming process to form the small-diameter portion 92 in the primary base material 9A. In the first forming process, the secondary base material 9B is obtained.

The second forming section 7 is a flange forming section that is used in the second forming process to form the flange portion 93 in the secondary base material 9B. In the second forming process, the formed product 9C is obtained.

In addition, the configurations of the first forming section 6 and the second forming section 7 will be described below.

As shown in FIGS. 1 and 2, the first moving mechanism unit 4 is a mechanism that independently moves the first forming section 6 in the X-axis direction (horizontal direction) and a Z-axis direction (vertical direction), respectively. The configuration of the first moving mechanism unit 4 is not particularly limited, and may be, for example, a configuration having a linear motion unit 41 and a motor 42.

The linear motion unit 41 is a portion that is connected to the first forming section 6 and moves the first forming section 6 straight in a predetermined direction, and is constituted by, for example, a linear guide, a ball screw, and the like.

The motor 42 is connected to the linear motion unit 41. As the motor 42 operates, the power thereof is transmitted to the first forming section 6 via the linear motion unit 41. Accordingly, the first forming section 6 can be moved. In addition, in the spinning device 1, by adjusting the voltage applied to the motor 42, the rotation speed of the motor 42 can be changed to change the movement speed of the first forming section 6.

Figure 4:
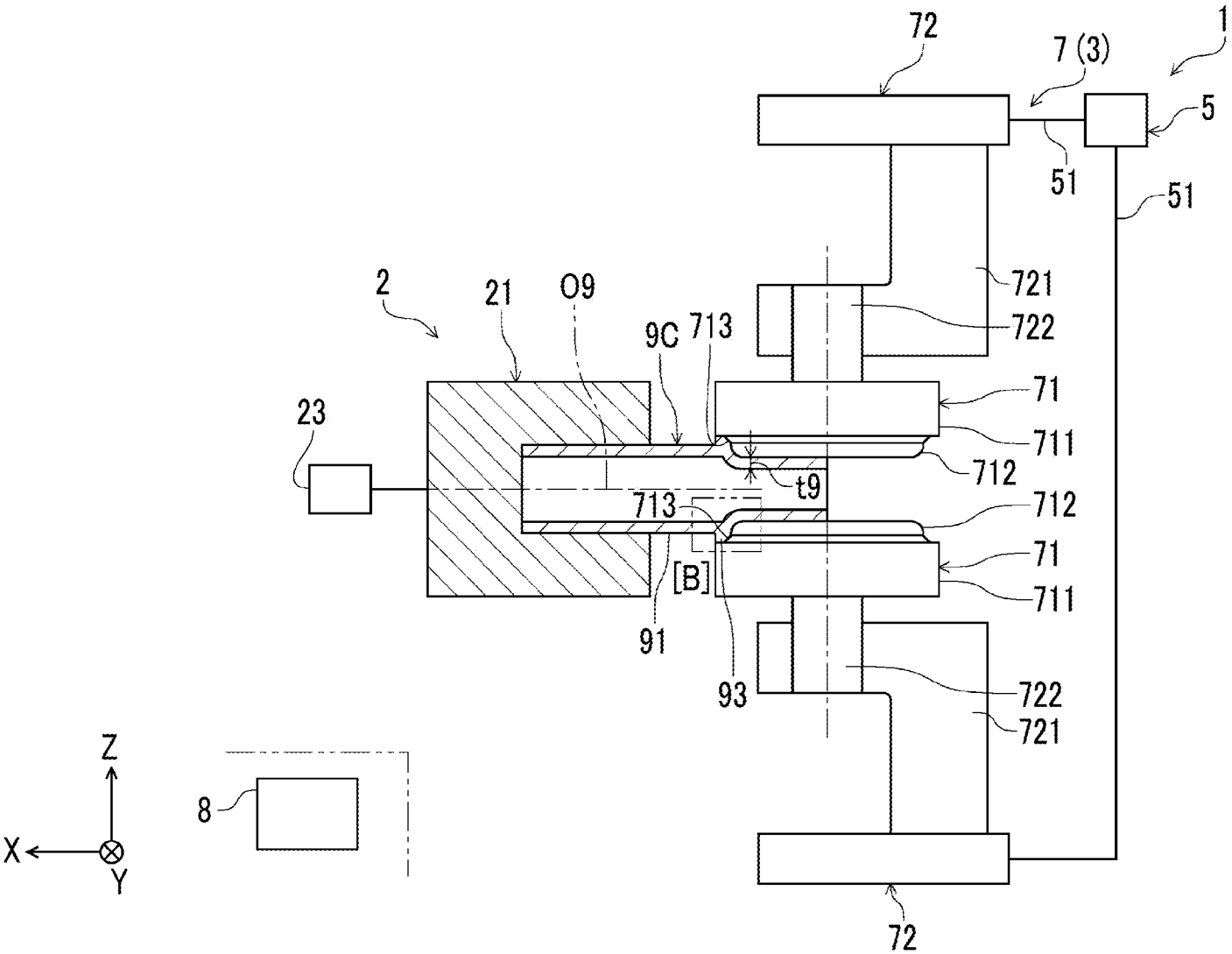
FIG. 4 is a partial vertical cross-sectional side view sequentially showing the operating state (during the flange portion forming) of the spinning device of the present invention (one embodiment).

As shown in FIGS. 3 and 4, the second moving mechanism unit 5 is a mechanism that independently moves the second forming section 7 in the X-axis direction (horizontal direction) and the Z-axis direction (vertical direction), respectively. The configuration of the second moving mechanism unit 5 is not particularly limited, and may be, for example, a configuration having a linear motion unit 51 and a motor 52.

The linear motion unit 51 is a portion that is connected to the second forming section 7 and moves the second forming section 7 straight in a predetermined direction, and is constituted by, for example, a linear guide, a ball screw, and the like.

The motor 52 is connected to the linear motion unit 51. By operating the motor 52, the power thereof is transmitted to the second forming section 7 via the linear motion unit 51. Accordingly, the second forming section 7 can be moved. In addition, in the spinning device 1, by adjusting the voltage applied to the motor 52, the rotation speed of the motor 52 can be changed to change the movement speed of the second forming section 7.

As shown in FIG. 7, the control unit 8 is electrically connected to the rotation support unit 2, the first moving mechanism unit 4, and the second moving mechanism unit 5, and can control the operation thereof. The control unit 8 has a CPU 81 and a storage unit 82. The CPU 81 can execute, for example, a control program stored in advance in the storage unit 82. The control program includes, for example, programs for controlling the operating conditions (operation timing) of the rotation support unit 2, the first moving mechanism unit 4, and the second moving mechanism unit 5 to form the base material 9 into the formed product 9C.

As previously mentioned, the machining unit 3 includes the first forming section 6 and the second forming section 7. The first forming section 6 is a small-diameter portion forming section that forms the small-diameter portion 92 in the primary base material 9A in the first forming process. The second forming section 7 is a flange forming section that forms the flange portion 93 in the secondary base material 9B in the second forming process.

As shown in FIGS. 1 and 2, the first forming section 6 has a first roller(roller) 61 and a first pivoting support portion 62 that pivotably supports the first roller 61. In the present embodiment, two sets of the first roller 61 and the first pivoting support portion 62 are disposed one above the other. Accordingly, the small-diameter portion 92 can be formed stably and rapidly.

In addition, the number of sets of the first roller 61 and the first pivoting support portion 62 is not limited to two, and may be, for example, one or three or more. Additionally, since each set has the same configuration except that the disposition spot is different, the configuration of one lower set will be described representatively.

The first pivoting support portion 62 has a base portion 621 and a shaft member 622.

The base portion 621 is connected to the linear motion unit 41 of the first moving mechanism unit 4.

The shaft member 622 has a columnar shape parallel to the center axis O9 of the primary base material 9A, that is, the X-axis, and is cantilevered by the base portion 621. Additionally, the shaft member 622 is connected to a central portion of the first roller 61.

The first roller 61 has a disk shape, and a center axis thereof is disposed parallel to the X-axis. The first roller 61 has a constant outer diameter portion 611 and a protrusion portion 612.

The constant outer diameter portion 611 is a portion where the outer diameter of the first roller 61 is constant in the X-axis direction.

The protrusion portions 612 are disposed adjacent to each other on the positive side in the X-axis direction with respect to the constant outer diameter portion 611. The protrusion portion 612 protrudes in a direction away from the center axis of the first roller 61, that is, outward, and is provided in a ring shape along an outer peripheral portion of the first roller 61.

A top 613 of the protrusion portion 612 is rounded, and a radius R613 (see FIG. 5) thereof is not particularly limited, but for example, the wall thickness t9 or more is preferable, and a wall thickness of 1 time or more and 3 times or less of the wall thickness t9 is more preferable. Thereby, a radius difference in outer diameter between the large-diameter portion 91 and the small-diameter portion 92 can be set in the above numerical range. Additionally, the outer diameter of the top 613 is the maximum outer diameter of the first roller 61.

When the small-diameter portion 92 is formed in the primary base material 9A, first, as shown in FIG. 1, the first roller 61 is brought into a state of being separated from the primary base material 9A to a negative side in the X-axis direction. Then, the rotation support unit 2 is operated to bring about a state in which the primary base material 9A is rotated. This rotational state is maintained until the forming of the small-diameter portion 92 is completed.

Next, as shown in FIG. 2, the first roller 61 is brought close to the primary base material 9A. Then, while the top 613 of the protrusion portion 612 is brought into contact with an outer peripheral portion of the primary base material 9A and moved in the direction (X-axis direction) of the center axis O9, the outer peripheral portion is pressed toward the center axis O9 side at the top 613. Accordingly, the outer diameter and the inner diameter of the other end portion of the primary base material 9A, which is the small-diameter portion 92 of the secondary base material 9B, that is, an end portion (part) on the negative side in the X-axis direction, can be collectively reduced and deformed (see FIG. 5). By this deformation, the small-diameter portion 92 can be formed, and the secondary base material 9B can be obtained. After that, the first forming section 6 is retracted from the secondary base material 9B.

Figure 5:
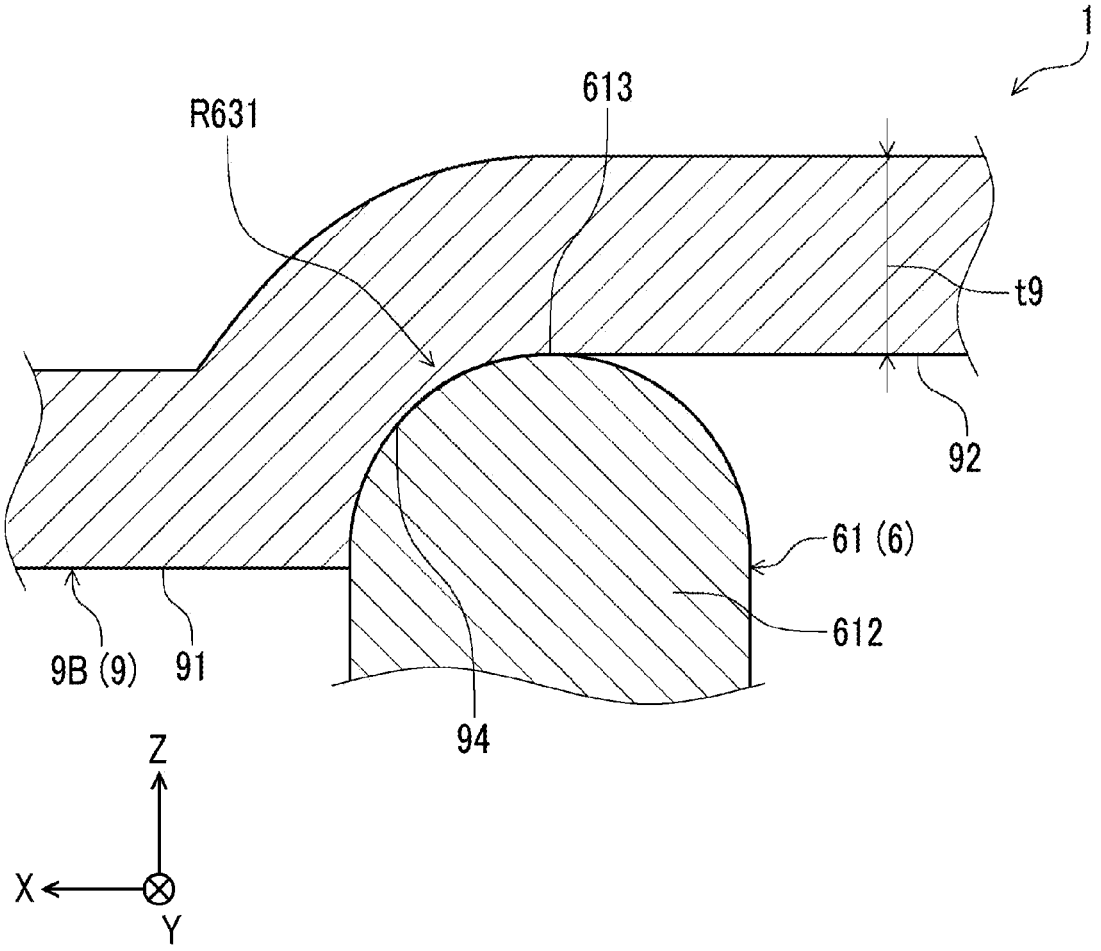
FIG. 5 is an enlarged view of a region [A] surrounded by the alternate long and short dash line in FIG. 2.

In addition, as shown in FIG. 5, the outer peripheral portion of the primary base material 9A is rounded such that a portion (step portion) 94 between the large-diameter portion 91 and the small-diameter portion 92 follows the shape of the top 613.

Additionally, since the outer diameter and the inner diameter of the primary base material 9A are collectively reduced as mentioned above, the wall thickness t9 in the secondary base material 9B is maintained to be constant with the size of the wall thickness t9 in the primary base material 9A. Here, the "constant" means that the wall thickness t9 after forming is within a range of 60% or more and 120% or less of the wall thickness t9 before forming (the same applies hereinafter).

As previously mentioned, the first roller 61 is rotatably supported around an axis parallel to the center axis O9. Since the small-diameter portion 92 is formed parallel to the center axis O9, it is preferable that the first roller 61 also rotates about an axis parallel to the center axis O9. In addition, the rotation axis of the first roller 61 may be inclined by a predetermined angle with respect to the axis parallel to the center axis O9 within a range in which the first roller 61 can exhibit the function thereof.

Additionally, the first roller 61 is an idle roller. Accordingly, when the protrusion portion 612 of the first roller 61 is brought into contact with the outer peripheral portion of the primary base material 9A, the first roller 61 follows the rotation of the primary base material 9A, that is, rotate in synchronization without difficulty. Thus, the small-diameter portion 92 can be accurately formed.

The diameter (maximum outer diameter) of the first roller 61 is not particularly limited, but is, for example, preferably 1 time or more and 10 times or less and more preferably 4 times or more and 8 times or less the outer diameter of the primary base material 9A (large-diameter portion 91). Accordingly, the outer peripheral portion of the primary base material 9A can be pressed toward the center axis O9 side without excess or deficiency by the top 613 of the protrusion portion 612, which contributes to rapid forming of the small-diameter portion 92.

As shown in FIGS. 3 and 4, the second forming section 7 has a second roller (roller) 71 and a second pivoting support portion 72 that pivotably supports the second roller 71. In the present embodiment, two sets of the second roller 71 and the second pivoting support portion 72 are disposed one above the other. Accordingly, the flange portion 93 can be formed stably and rapidly.

In addition, the number of sets of the second roller 71 and the second pivoting support portion 72 is not limited to two, and may be, for example, one or three or more. Additionally, since each set has the same configuration except that the disposition spot is different, the configuration of one lower set will be described representatively.

The second pivoting support portion 72 has a base portion 721 and a shaft member 722.

The base portion 721 is connected to the linear motion unit 51 of the second moving mechanism unit 5.

The shaft member 722 has a columnar shape parallel to the Z-axis and is cantilevered by the base portion 721. Additionally, the shaft member 722 is connected to a central portion of the second roller 71.

The second roller 71 has a disk shape, and a center axis thereof is disposed parallel to the Z-axis. The second roller 71 has a constant outer diameter portion 711, a convexly curved portion 712, and a tapered portion 713.

The constant outer diameter portion 711 is a portion where the outer diameter of the second roller 71 is constant in the Z-axis direction. The outer diameter of the constant outer diameter portion 711 is the maximum outer diameter of the second roller 71.

The convexly curved portion 712 is disposed on an upper side of the constant outer diameter portion 711. The convexly curved portion 712 is rounded and overhangs, and a radius R712 (see FIG. 6) thereof is not particularly limited, but is preferably the same as, for example, the radius R613 of the top 613. Accordingly, when the large-diameter portion 91 is pressed in the direction of the center axis O9 by the convexly curved portion 712 as described below, it is possible to prevent a situation in which a rounded portion 94 between the large-diameter portion 91 and the small-diameter portion 92 may be deformed unintentionally to hinder the forming of the flange portion 93.

Figure 6:
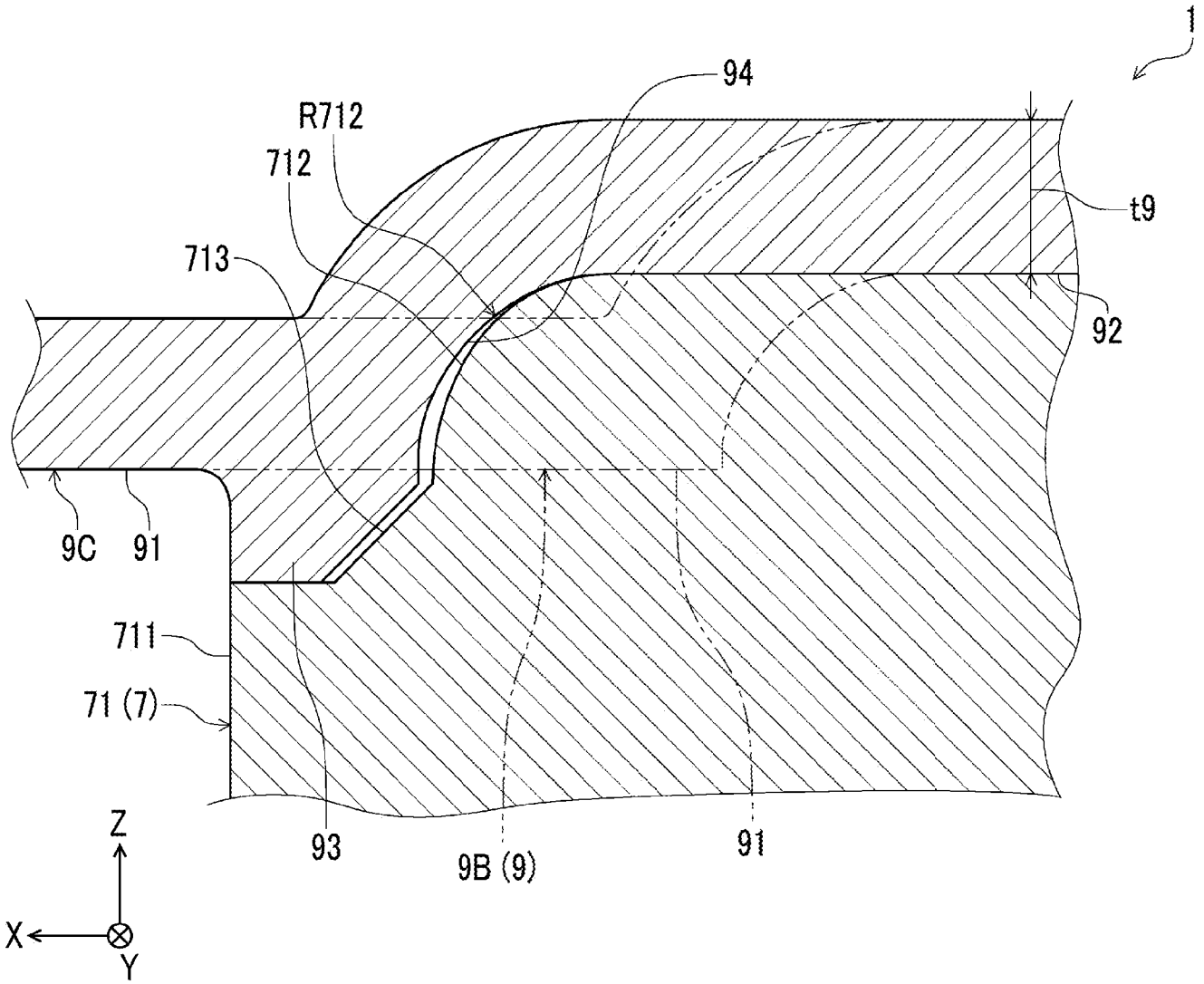
FIG. 6 is an enlarged view of a region [B] surrounded by an alternate long and short dash line in FIG. 4.

The tapered portion 713 is disposed between the constant outer diameter portion 711 and the convexly curved portion 712, respectively. As shown in FIG. 6, each tapered portion 713 is a portion where the outer diameter of the second roller 71 gradually increases toward the constant outer diameter portion 711 side. In addition, a portion drawn by the alternate long and short dash line in FIG. 6 is overlappingly shown by assuming the state of FIG. 5.

When the flange portion 93 is formed in the secondary base material 9B, first, as shown in FIG. 3, the second roller 71 is brought into a state of being separated from the secondary base material 9B to the negative side in the X-axis direction. Then, the rotation support unit 2 is operated to bring about a state in which the secondary base material 9B is rotated. This rotational state is maintained until the forming of the flange portion 93 is completed.

Next, as shown in FIG. 4, the second roller 71 is brought close to the secondary base material 9B. Then, while the second roller 71 is brought into contact with the outer peripheral portion of the small-diameter portion 92 and moved in the direction (X-axis direction) of the center axis O9, the large-diameter portion 91 is pressed in the direction of the center axis O9, that is, toward the positive side in the X-axis direction by the convexly curved portion 712. Accordingly, the large-diameter portion 91 is partially crushed and reduced in diameter to be a diameter-reduced portion 92. Additionally, when a part of the large-diameter portion 91 becomes the diameter-reduced portion 92, a surplus of volume is generated in the large-diameter portion 91 by that amount. This surplus is raised and deformed in the direction away from the center axis O9. Then, the raised portion reaches the constant outer diameter portion 711 and the tapered portion 713 and is adjusted to the shape of the flange portion 93 (see FIG. 6). Accordingly, the flange portion 93 can be formed at a boundary portion of the large-diameter portion 91 with the small-diameter portion 92, that is, between the large-diameter portion 91 and the small-diameter portion 92, to obtain the formed product 9C. After that, the second forming section 7 is retracted from the formed product 9C.

Additionally, as described above, in the secondary base material 9B, the large-diameter portion 91 is pressed toward the positive side in the X-axis direction. Such pressing allows the wall thickness t9 to decrease (change). Accordingly, the wall thickness t9 in the formed product 9C obtained from the secondary base material 9B is not reduced as much as possible, and is maintained to be constant with the size of the wall thickness t9 in the secondary base material 9B. Here, the "constant" is the same as described above.

As described above, according to the spinning device 1 (spinning method), when the flange portion 93 is formed in the base material 9, the flange portion 93 can be easily formed while maintaining the wall thickness t9 of the base material 9. Accordingly, the formed product 9C is prevented from being lowered in strength (mechanical strength) due to a decrease in the wall thickness t9, and thus can sufficiently withstand the actual usage environment used as a shaft.

As previously mentioned, the second roller 71 is rotatably supported around the axis perpendicular to the center axis O9, that is, around the Z-axis. Since the portion (a part of the large-diameter portion 91) of the secondary base material 9B pressed by the convexly curved portion 712 of the second roller 71 is parallel to the Z-axis direction, the center axis (rotation axis) of the second roller 71 is preferably parallel to the Z-axis. In addition, the rotation axis of the second roller 71 may be inclined by a predetermined angle with respect to an axis perpendicular to the center axis O9 within a range in which the second roller 71 can exhibit the function thereof.

Additionally, the second roller 71 is an idle roller. Accordingly, when the second roller 71 is brought into contact with the outer peripheral portion of the secondary base material 9B, the second roller 71 follows the rotation of the secondary base material 9B, that is, rotates in synchronization without difficulty. Thus, the flange portion 93 can be accurately formed.

The diameter of the convexly curved portion 712 of the second roller 71 is not particularly limited, but is, for example, preferably 1 time or more and 10 times or less and more preferably, 4 times or more and 8 times or less the outer diameter of the large-diameter portion 91. Accordingly, the large-diameter portion 91 can be pressed by the convexly curved portion 712 without excess or deficiency, which contributes to rapid forming of the flange portion 93.

Another Embodiment

Hereinafter, another embodiment of the spinning device and the spinning method of the present invention will be described with reference to FIGS. 9 and 10, but the differences from the above-mentioned embodiment will be mainly described, and descriptions of the same matters will be omitted.

The present embodiment is the same as the one embodiment except that the configuration of the rotation support unit 2 is different.

In the present embodiment, the rotation support unit 2 can take a first connection state in which the rotation support unit 2 is connected to the first forming section 6 and a second connection state in which the rotation support unit 2 is connected to the second forming section 7, by a switching mechanism (not shown).

Figure 9:
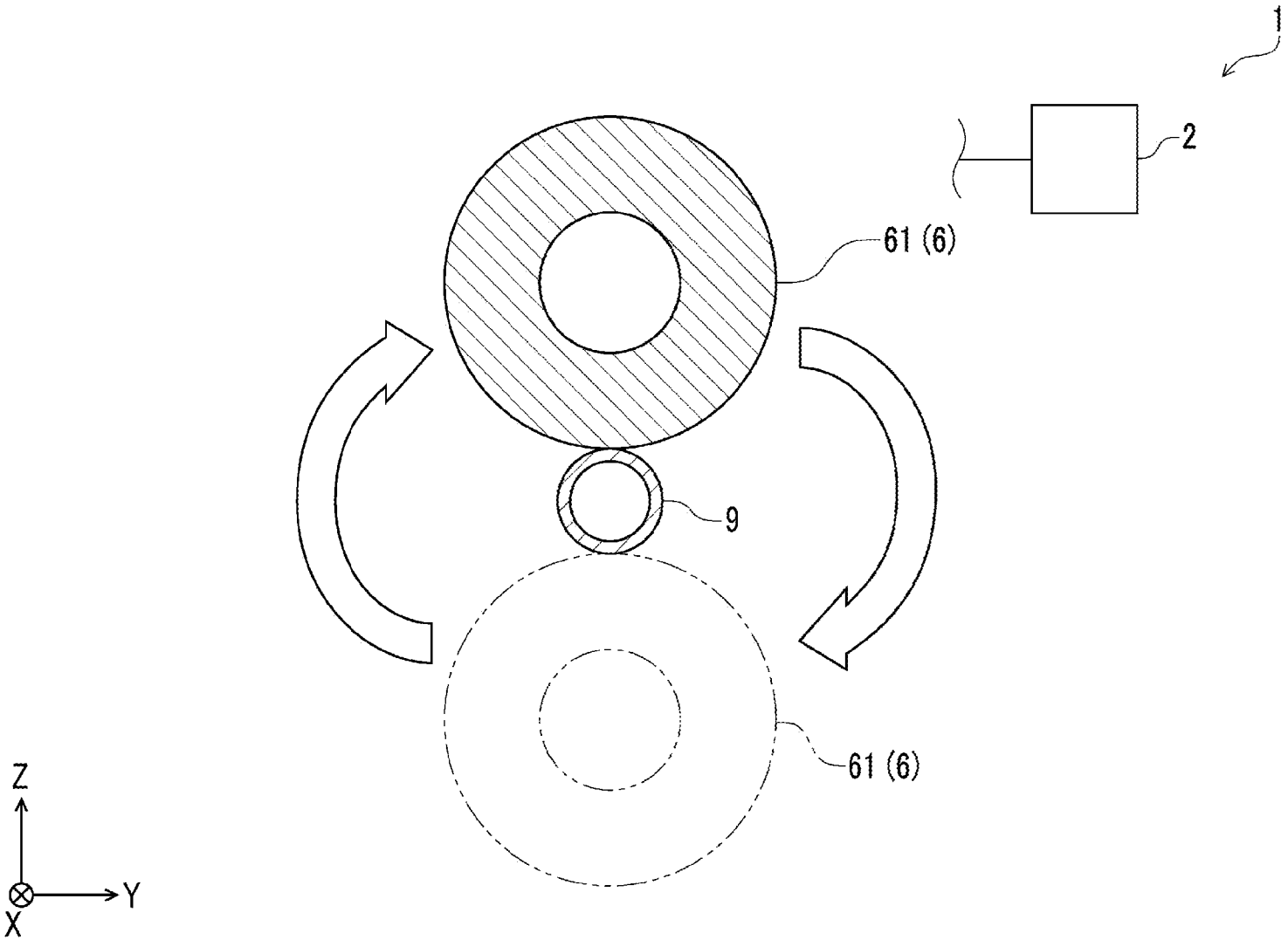
FIG. 9 is a partial vertical cross-sectional view sequentially showing the operating state (during the small-diameter portion forming) of a spinning device (another embodiment) of the present invention.

Then, in the first connection state, as shown in FIG. 9, the rotation support unit 2 is in a state in which the base material 9 is fixed, and the first forming section 6 can be rotated around the base material 9 (center axis O9) with respect to the base material 9. In addition, the first forming section 6 has two first rollers 61, and in FIG. 9, one first roller 61 is drawn representatively.

Figure 10:
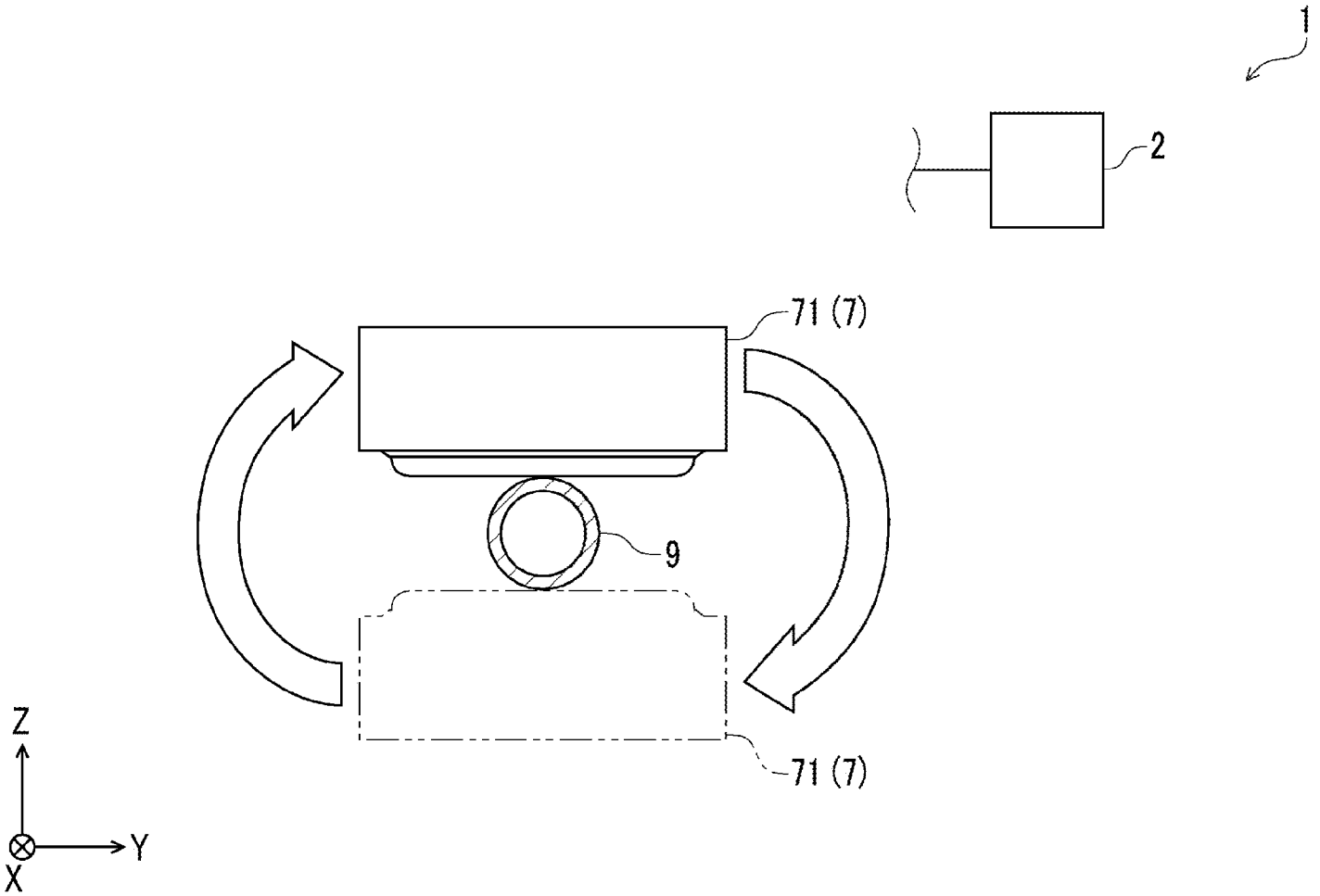
FIG. 10 is a partial vertical cross-sectional view sequentially showing the operating state (during flange portion forming) of the spinning device (another embodiment) of the present invention.

Additionally, in the second connection state, as shown in FIG. 10, the rotation support unit 2 is in a state in which the base material 9 is fixed, and the second forming section 7 can be rotated around the base material 9 (center axis O9) with respect to the base material 9). In addition, the second forming section 7 has two second rollers 71, and in FIG. 10, one second roller 71 is drawn representatively.

The rotation support unit 2 having the configuration as described above can also smoothly perform the rotation process, and thus can easily and accurately form the base material 9.

Although the spinning device and the spinning method of the present invention have been described above with respect to the shown embodiments, the present invention is not limited thereto. Additionally, the respective parts constituting the spinning device can be replaced with optional components capable of exhibiting the same functions.

Additionally, optional components may be added. Additionally, the spinning device and the spinning method of the present invention may be a combination of two or more optional components (features) in each of the above-described embodiments.

It should be understood that the invention is not limited to the above-described embodiment, but may be modified into various forms on the basis of the spirit of the invention. Additionally, the modifications are included in the scope of the invention.

What is claimed is:

1. A spinning device comprising:

one or more rollers that are rotatable around an axis perpendicular to a center axis of a base material; and a motor that is configured to rotate the one or more rollers;

wherein the one or more rollers, in a state where the base material having a tubular shape and including at least a large-diameter portion and a small-diameter portion is relatively rotated, are configured to form a flange portion protruding from an outer periphery of the large-diameter portion in a direction away from the center axis of the base material, each of the one or more rollers includes a constant outer diameter portion, a convexly curved portion that is disposed on an upper side of the constant outer diameter portion and is rounded and overhangs, and a portion where an outer diameter of the roller gradually increases toward the constant outer diameter portion side, disposed between the constant outer diameter portion and the convexly curved portion, and the convexly curved portion is configured to press by pressing the large-diameter portion in a center axis direction of the base material in a direction parallel to the center axis while contacting an outer peripheral portion of the small-diameter portion, so that a part of the large- diameter portion is protruded in the direction away from the center axis and reaches the constant outer diameter portion and the portion to be adjusted to a shape of the flange portion.

2. The spinning device according to claim 1, further comprising a pivoting support portion that pivotably supports the one or more rollers, and another set of one or more rollers and the pivoting support portion are disposed one above the other.

3. The spinning device according to claim 2, wherein the pivoting support portion includes a base portion and a shaft member.

4. The spinning device according to claim 3, wherein the shaft member has a columnar shape parallel to a Z-axis and is cantilevered by the base portion.

5. The spinning device according to claim 1, wherein each of the one or more rollers has a disk shape, and a center axis of each of the one or more rollers is disposed parallel to a Z-axis.

6. The spinning device according to claim 1, further comprising an additional roller that is rotatable around an axis parallel to the center axis, wherein the base material has a state of a primary base material of which a size of an outer diameter is constant in the direction parallel to the center axis and a state of a secondary base material including the large-diameter portion and the small-diameter portion, and the additional roller is configured to form the small-diameter portion by reducing an outer diameter of a part of the primary base material that becomes the small-diameter portion in the secondary base material.

7. The spinning device according to claim 1, further comprising a rotation support unit that rotatably supports the base material and the one or more rollers around the center axis.

8. The spinning device according to claim 7, wherein the rotation support unit includes a chuck that holds one end side of the base material and another motor that applies power to the chuck.

9. The spinning device according to claim 1, wherein the motor independently moves the one or more rollers in an X-axis direction and a Z-axis direction.

10. The spinning device according to claim 9, wherein the the motor is a linear motion unit that moves the the one or more rollers in a straight line.

11. A spinning method comprising:

a machining process of performing machining on a base material having a tubular shape and including at least a large-diameter portion and a small-diameter portion, wherein in the machining process, a flange forming section is used to form a flange portion protruding from an outer periphery of the large-diameter portion in a direction away from a center axis of the base material, the flange forming section has a roller that is rotatable around an axis perpendicular to the center axis, the roller includes a constant outer diameter portion, a convexly curved portion that is disposed on an upper side of the constant outer diameter portion and is rounded and overhangs, and a portion where an outer diameter of the roller gradually increases toward the constant outer diameter portion side, disposed between the constant outer diameter portion and the convexly curved portion, and the convexly curved portion presses the large-diameter portion in a direction parallel to the center axis while contacting an outer peripheral portion of the small-diameter portion in a state where the base material is relatively rotated, so that a part of the large-diameter portion is protruded in the direction away from the center axis and reaches the constant outer diameter portion and the portion to be adjusted to a shape of the flange portion.

* * * * *